United States Patent [19]

Sokolowski

[11] 4,441,624

[45] Apr. 10, 1984

[54] DRINKING COVER

[76] Inventor: Bronislaw Sokolowski, 44 Aldrich St., Webster, Mass. 01570

[21] Appl. No.: 459,412

[22] Filed: Jan. 20, 1983

[51] Int. Cl.[3] ..... B65D 41/26; B65D 47/04

[52] U.S. Cl. ..... 220/254; 220/90.4; 220/367; 222/508; 222/511; 222/517; 229/7 R

[58] Field of Search ..... 220/90.4, 90.2, 254, 220/268, 367; 229/7 R; 222/570, 511, 508, 517; D9/435, 447, 449

[56] References Cited

U.S. PATENT DOCUMENTS

| | | | |
|---|---|---|---|
| D. 133,978 | 10/1942 | Johnson | D9/447 |
| D. 241,125 | 8/1976 | Knapp | 259/447 |
| 2,851,203 | 9/1958 | Nowak | 215/307 X |
| 2,970,737 | 2/1961 | Rice | 229/7 R |
| 3,334,775 | 8/1967 | Klein et al. | 220/268 |
| 3,749,274 | 7/1973 | Mele et al. . | |
| 3,927,794 | 12/1975 | Erdman . | |
| 4,090,660 | 5/1978 | Schram et al. . | |
| 4,136,799 | 1/1979 | Albert | 220/90.4 X |
| 4,138,033 | 2/1979 | Payne et al. . | |
| 4,184,604 | 1/1980 | Amberg et al. . | |
| 4,190,174 | 2/1980 | Haimowitz . | |
| 4,215,793 | 8/1980 | Packard . | |
| 4,345,695 | 8/1982 | Galloway et al. . | |
| 4,350,260 | 9/1982 | Prueher . | |
| 4,361,249 | 11/1982 | Tuneski et al. | 220/254 |

*Primary Examiner*—Allan N. Shoap

*Attorney, Agent, or Firm*—Blodgett & Blodgett

[57] ABSTRACT

Drinking cover for a beverage container comprising a circular top wall and annular side wall with sealing means on the bottom periphery of the side wall for securing the cover to the upper rim of a beverage container. The top wall is tapered downwardly from front to back and contains an opening. A sealing flap underlies the opening and is attached to the bottom surface of the top wall so that the flap is movable from a closed position to an open position with respect to the opening.

18 Claims, 5 Drawing Figures

DRINKING COVER

BACKGROUND OF THE INVENTION

This invention relates generally to covers for beverage containers and more specifically, to covers which permit the drinking of the contents of the container while the cover is still in place.

It is well known to provide covers for drinking containers to prevent the spillage of the contents of the container. Many prior art covers incorporate an opening in the top of the cover in order to allow drinking of the contents, either in the normal drinking fashion or by the insertion of a straw. Some covers utilize a releasable drinking flap in order to prevent the sloshing of the contents out of the containers. Other covers have an opening which is sealed by a depressable tab. When the tab is depressed, the opening is unsealed for either drinking the contents of the container or pouring the contents from the container.

Most of the prior art covers are designed to be opened permanently or to be manually resealed after opening. Some covers provide for the opening and closing of the cover by the application of pressure from the lips of the drinker. Most of the prior art covers are so complicated in construction that the price of manufacturing the cover is prohibitive for use with with typical throw-away containers, such as those used in the fast food industry. In addition, most of the covers are so awkward to use, that they have not been accepted by consumers.

Another major problem which is inherent in drinking covers is that the cover prevents the container from being tilted relative to the mouth due to the fact that the cover strikes the nose of the drinker. In order to drink from the container having such a cover, the head of the individual must be tilted backward which is very awkward and annoying for the individual. The biggest objection to the prior art drinking covers is that none of them effectively prevents leakage of the contents of the container through the opening of the cover. This is true even for covers which have a valve for the opening. The valve prevents major spillage of the contents, but does not prevent leakage of the contents when the container is tipped to an appreciable degree. These and other difficulties experienced with the prior art devices have been obviated by the present invention.

It is, therefore, an outstanding object of the invention to provide a drinking cover which is leak-proof even when the container is inverted.

Another object of this invention is the provision of a drinking cover having a construction which allows clearance for the nose of the drinker, so that the container can be tipped about the lips of the drinker in a normal drinking fashion.

A further object of the present invention is the provision of a drinking cover having a normally closed valve which is opened by application of lip pressure to the top of the cover.

It is another object of the instant invention to provide a drinking cover which is simple in construction, which is inexpensive to manufacture, and which is easy to use.

With these and other objects in view, as will be apparent to those skilled in the art, the invention resides in the combination of parts set forth in the specification and covered by the claims appended hereto.

SUMMARY OF THE INVENTION

A cover for a beverage container comprising a circular top wall of flexible material which has an opening near one edge of the wall, an annular side wall which extends downwardly from the edge, sealing means on the bottom periphery of the side wall for securing the cover to the rim of a container and, a sealing flap which underlies the opening in the top wall and which is normally in sealing relationship with the opening. The flap is attached to the underside of the top wall so that it is movable to an unsealing position with respect to the opening upon application of downward pressure to the top wall which is sufficient to deflect the top wall. The invention also consists of a cover for a beverage container comprising a circular top wall having an opening near the front edge of the top wall, an annular side wall which gradually tapers downwardly from the front edge of the top wall to the rear edge thereof, so that the top wall gradually tapers downwardly from the front to the back of the top wall, sealing means on the bottom periphery of the side wall for securing the cover to the rim of a container and, a sealing flap which underlies the opening in the top wall and which is attached to the bottom surface of the top wall so that the flap is movable from a closed position in which the flap seals the opening to an open position in which the flap is in a non-sealing relationship with the opening.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 2:
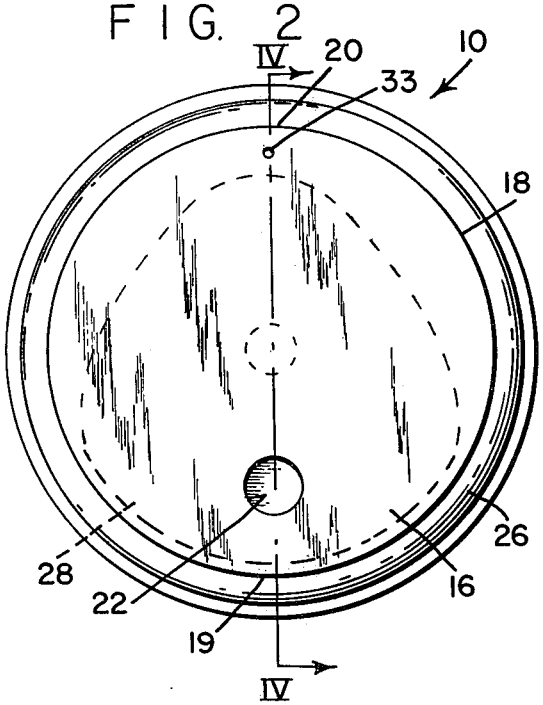
FIG. 2 is a top plan view of the cover.

Referring first to FIGS. 1–4, which show the general features of the invention, the drinking cover is generally indicated by the reference numeral 10 and is shown applied to a conventional drinking cup 12. The drinking cup 12 is shown in dot-and-dash lines and includes an upper annular rim 14.

Figure 1:
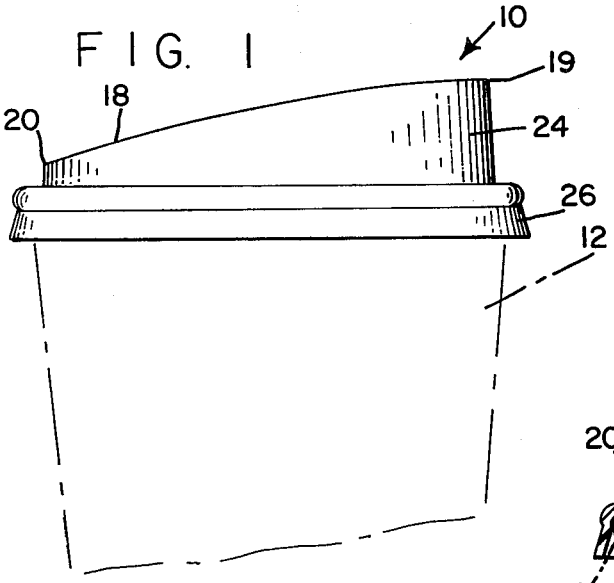
FIG. 1 is a side elevational view of a drinking cover embodying the principles of the present invention.
Figure 4:
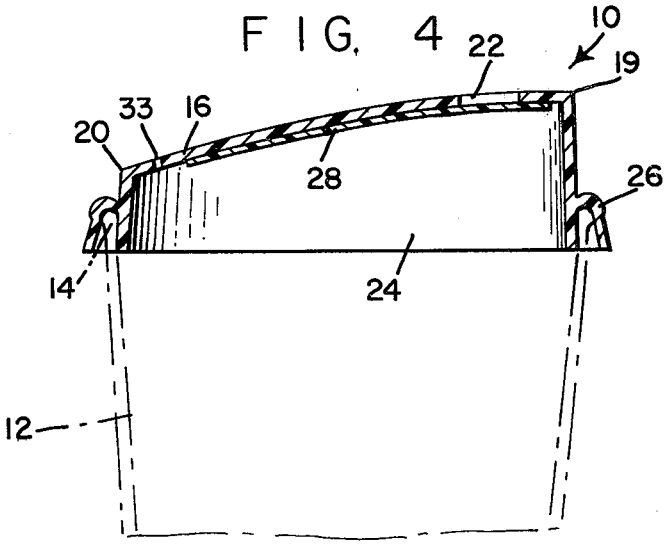
FIG. 4 is a vertical cross-sectional view of the cover taken on the line IV—IV of FIG. 2.

The cover 10 includes a circular top wall 16 having an annular peripheral edge which is generally indicated by the reference numeral 18. The edge 18 has a front portion 19 and a rear portion 20. The top wall 10 has an opening 22 near the front portion 19 but spaced from the peripheral edge 18. An annular side wall 24 extends downwardly from the edge 18 and terminates in an inverted U-shaped rim about its bottom periphery. The rim 26 is adapted to fit snugly over the upper annular rim 14 of the beverage container 12 as shown in FIG. 4, so that the cover is securely sealed on the beverage container. The side wall 24 tapers downwardly from the front edge portion 19 to the rear edge portion 20 as shown in FIG. 1, so that the top wall 16 gradually tapers downwardly from the front edge portion 19 to the rear edge portion 20. The top wall 16 also has a slight upward curvature from the edge 18 as shown in FIGS. 1 and 4. A top wall curvature of less than 6° is preferred.

The annular side wall 24 also tapers outwardly in a downward direction from the edge 18 to enable the cover 10 to be nested with other identical covers. The cover 10 also includes a sealing flap 28 which is attached to the under surface 32 of the top wall 16 at a limited area 30. The flap 28 may be attached to the top wall 16 at area 30 in any conventional manner, as for example, riveting, welding, or the use of adhesive. The attaching area 30 is located approximately at the center of the top wall 16 and is spaced from the opening 22.

Figure 3:
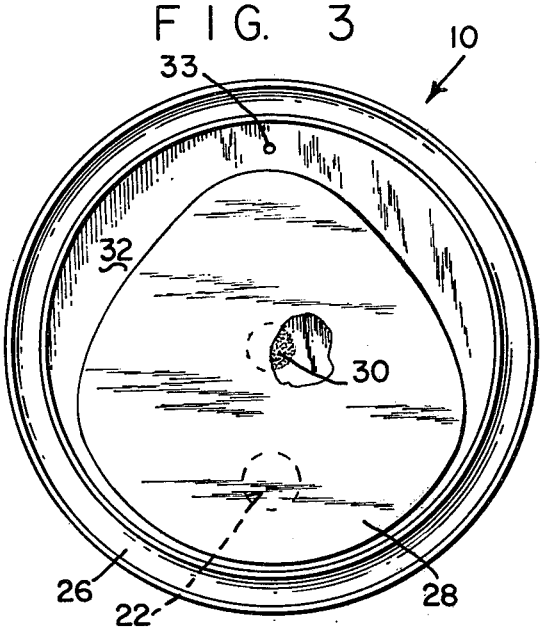
FIG. 3 is a bottom plan view of the cover.

Referring particularly to FIGS. 2–4, the flap 28 underlies the opening 22 and lies flat against the under surface 32 so that the flap is normally in a sealing position with respect to the opening 22, as shown in FIG. 4. The top wall 16 and the flap 28 are both made from a flexible material, preferably a heat resistent thermoplastic material suitable for hot and cold beverages. It is preferred that the top wall 16 and the flap 28 are made of the same thermoplastic material and that the flap 28 is substantially thinner than the top wall 16. A top wall to flap ratio of 2 to 1 is preferred. The flap 28 of the preferred embodiment is also made of a flat material. However, when the flap 28 is attached to the under surface of the top wall 16, it conforms to the curvature of the top wall as shown in FIG. 4. This is possible because the top wall 16 is considerably stiffer than the flap 28. This difference in stiffness is due in part to the fact that the top wall is considerably thicker than the flap and that the top wall is supported along its peripheral edge by the side wall 24. It is also contemplated that the top wall 16 and the flap 28 can be the same thickness if they are constructed of different thermoplastic materials in which the top wall 16 is made from a material which is considerably stiffer than the material from which the flap 28 is made. If desired, a conventional vent opening 33 is provided in the top wall 16 for use with hot beverage containers.

Figure 5:
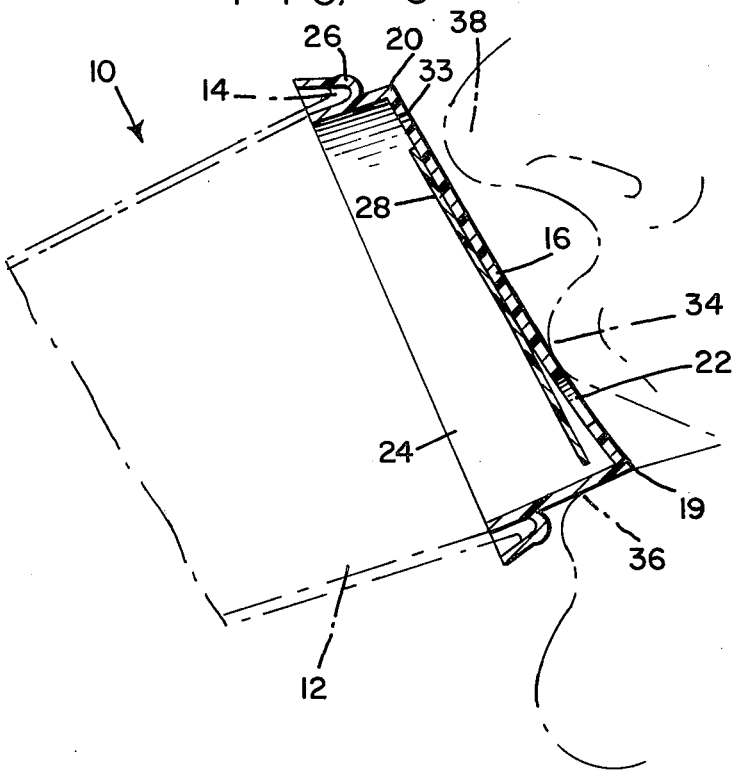
FIG. 5 is a view similar to FIG. 4 showing the cover being utilized by a drinker.

The operation and advantages of the present invention will now be readily understood in view of the above description. FIG. 4 represents the normal closed condition of the drinking cover 10 when it is applied to a beverage container. In this condition, the closure flap 28 lies flat against the under surface 32 of the top wall 16. The flap 28 is in the closed position with respect to the opening 22. The cover 10 is used for drinking as illustrated in FIG. 5 by raising the container 12 to the mouth so that the drinker's lower lip 36 presses against the front portion of the side wall 24 and the drinker's upper lip 34 presses against the top wall 16 just behind the opening 22. When the container 12 is held in this position as illustrated in FIG. 5, the upper and lower lips 34 and 36, respectfully, of the drinker form a seal about the front edge 19 and the opening 22. By applying a gentle pressure against the top cover 16 by the upper lip 34, the top wall 16 is deflected from its upwardly curved position as shown in FIG. 4 to a flat or slightly downwardly curved position as shown in FIG. 5. This action releases the sealing flap 28 from its snug engagement with the under surface 32 of the top wall, so that the flap essentially pivots about the limited attaching area 30. The portion of the flap 28 which underlies the opening 22 assumes its natural flat condition and is spaced from the opening 22 as clearly illustrated in FIG. 5. This allows the contents of the container 12 to pass through the opening 22 into the drinker's mouth. If desired, the flow of liquid may be increased somewhat by applying a slight suction with the mouth, since it is possible to depress the top cover 16 while maintaining a seal around the opening 22.

It has been found that the flap 28 provides a better seal with respect to the opening 22 if it overlies the hole to a substantial degree. An excellent seal is achieved if the flap overlaps the hole by a distance which is equal to at least one-half the diameter of the hole at the forwardmost point of the hole and a distance which is at least equal to the diameter of the opening 22 at the lateral points of the opening 22. The lateral points are on a line which extends through the center of the opening 22 and transversely of a line which extends through the center of the opening 22 and the center of the top wall 16. The amount of overlap gradually increases from the forwardmost point to each lateral point.

The downward front to back slope of the top wall 16 provides clearance for the nose 38 of the drinker when the cup 12 is raised to the normal drinking position as clearly illustrated in FIG. 5.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Cover for a beverage container having an annular upper rim, said cover comprising:

(a) a circular top wall having a peripheral edge, said edge having a front portion and an opposite rear portion, said top wall having an opening which is near the front portion of said edge and spaced from said edge, (b) an annular side wall which extends downwardly from said edge, the top of said side wall gradually tapering downwardly from said front portion to said rear portion so that the top wall gradually tapers downwardly from said front portion to said rear portion, (c) sealing means on the bottom periphery of the side wall for securing the cover to the rim of the container, and (d) a sealing flap which underlies said opening and which is attached to the inner surface of the top wall, the flap being movable from a closed position in which the flap seals the opening to an open position in which the flap is in a non-sealing relationship with the opening, the top wall being made of a flexible material and the sealing flap being attached to the top wall at a limited area which is spaced from the opening, so that the flap is free to pivot about said limited area to move from said closed position to said open position upon application of downward force against said top wall, wherein the inner surface of the top wall is normally concave, and the flap is sufficiently flexible to conform to the curvature of the said inner surface of the top wall and in contact therewith, so that the flap is parallel with the top wall in said closed position.

2. Cover as recited in claim 1, wherein the sealing flap and the top wall are both made of thermoplastic material and the flap is attached to the top wall by a spot weld.

3. Cover as recited in claim 1, wherein the flap is glued to the top wall at said limited area.

4. Cover as recited in claim 1, wherein the curvature of the top wall is less than 6°.

5. Cover as recited in claim 1, wherein the top wall and the flap are made of the same thermoplastic material and the flap is substantially thinner than the top wall.

6. Cover as recited in claim 5, wherein the top wall is approximately twice as thick as the flap.

7. Cover as recited in claim 1, wherein the opening is circular and is spaced from said edge a distance equal to at least the radius of the opening.

8. Cover as recited in claim 1, wherein the flap overlaps the opening by a distance equal to at least the diameter of the opening on opposite sides of the opening along a line which intersects the center of the opening and is transverse to a line which intersects the opening and the center of said limited area.

9. Cover as recited in claim 1, wherein the side wall of the cover tapers outwardly from said edge sufficiently to permit nesting of said cover with other identical covers.

10. Cover for a beverage container having an annular upper rim, said cover comprising:

(a) a circular top wall which is made of flexible material and which has an annular peripheral edge, said edge having a front portion and an opposite rear portion, said top wall having an opening which is near the front portion of said edge and spaced from said edge, the inner surface of said top wall being axially outwardly curved, (b) an annular side wall which extends downwardly from said edge, (c) sealing means on the bottom periphery of the side wall for securing the cover to the rim of the container, and (d) a sealing flap which unlerlies said opening and which is attached to the said inner surface of the top wall intermediate the front and rear portions, so that the flap is movable from a closed position to an open position relative to the opening, said flap normally occupying said closed position and is movable to said open position upon application of downward pressure on the top wall, said top wall being capable of deflecting axially inwardly upon application of pressure to said top wall adjacent said opening thereby causing said flap to pivot about its location of attachment to said top wall and causing said open position.

11. Cover as recited in claim 10, wherein the curvature of the top wall is less 6°.

12. Cover as recited in claim 10, wherein the flap is made of a flexible material and is attached to the under surface of the top wall at a limited area which is spaced from the opening so that the flap is free to pivot about said limited area.

13. Cover as recited in claim 12, wherein the flap is made of a normally flat material which is sufficiently flexible to conform to the curvature of the top wall so that the flap is parallel with the top wall in said closed position.

14. Cover as recited in claim 13, wherein the top wall and the flap are made of the same thermoplastic material and the flap is substantially thinner than the top wall.

15. Cover as recited in claim 14, wherein the top wall is approximately twice as thick as the flap.

16. Cover as recited in claim 12, wherein the opening is circular and is spaced from said edge a distance equal to at least the radium of the opening.

17. Cover as recited in claim 16, wherein the flap overlaps the opening by a distance which is equal to at least the diameter of the opening an opposite sides of the opening along a line which intersects the center of the opening and is transverse to a line which intersects the opening and the center of said limited area.

18. Cover as recited in claim 10, wherein the side wall of the cover tapers outwardly from said edge sufficiently to permit nesting of said cover with other identical covers.

* * * * *